United States Patent [19]

Ueda

[11] 4,261,377

[45] Apr. 14, 1981

[54] APPARATUS FOR ASSORTING AND COUNTING COINS

[75] Inventor: Nobuo Ueda, Tokyo, Japan

[73] Assignee: Laurel Bank Machine Co., Ltd., Tokyo, Japan

[21] Appl. No.: 973,673

[22] Filed: Dec. 27, 1978

[51] Int. Cl.[3] ..... G07D 3/02; G07D 3/16

[52] U.S. Cl. ..... 133/3 D; 133/3 F; 133/8 E

[58] Field of Search ..... 133/3 R, 3 D, 3 F, 3 H, 133/8 R, 8 E

[56] References Cited

U.S. PATENT DOCUMENTS

| | | | |
|---|---|---|---|
| 3,079,934 | 3/1963 | Thompson | 133/8 R |
| 3,726,290 | 4/1973 | Zimmermann | 133/3 R |
| 4,059,122 | 11/1977 | Kinoshita | 133/3 D |

FOREIGN PATENT DOCUMENTS

| | | | |
|---|---|---|---|
| 2623974 | 12/1977 | Fed. Rep. of Germany | 133/3 F |
| 45-34084 | 11/1970 | Japan . | |
| 52-17094 | 2/1977 | Japan . | |

*Primary Examiner*—F. J. Bartuska

*Attorney, Agent, or Firm*—Fleit & Jacobson

[57] ABSTRACT

Mixed coins to be assorted and counted are transferred in one direction on an assorting and counting track by an assorting belt mechanism. The transferred coins are allowed to fall through various holes differing in width in accordance with the sizes of the coins. The holes are formed on the bottom face of the assorting and counting track. There are disposed for each assorting hole an inclined counting stand having a width slightly larger than the diameter of corresponding coins to be introduced into the assorting hole and having one end thereof inclined and a counting device for counting the number of the coins introduced into the inclined counting stand.

2 Claims, 6 Drawing Figures

APPARATUS FOR ASSORTING AND COUNTING COINS

BACKGROUND OF THE INVENTION

The present invention relates to a coin assorting and counting apparatus in which so called mixed coins, namely various kinds of coins, are assorted and the numbers of respective kinds of coins are counted on a horizontal assorting and counting track.

A conventional assorting and counting apparatus of this type (for example, one disclosed in Japanese Laid Open Publication No. 17094/1977) comprises a horizontal assorting mechanism and a counting mechanism disposed below the assorting mechanism. The counting mechanism includes a pair of belts for receiving coins allowed to fall from respective assorting holes, a driving zone for driving said belts and a counting zone for counting the number of coins received on the belts. Since this apparatus comprises two large mechanisms, the apparatus is inevitably large in size and very expensive.

In a conventional horizontal counting apparatus (for example, one disclosed in Japanese Patent Publication No. 34084/1970), since it is intended to count the number of coins assorted by each assorting hole based on the difference between the number of coins allowed to fall and the number of coins passing in front of each assorting hole, it is necessary to provide a circuit for memorizing the number of passing coins and an operation circuit for performing a subtraction operation. The structure of the counting circuit as a whole is complicated and the counting apparatus is very expensive.

SUMMARY OF THE INVENTION

The present invention has been perfected as a result of investigations made with a view to eliminating the foregoing disadvantages of the conventional techniques. If is therefore a primary object of the present invention to provide a relatively inexpensive apparatus for assorting and counting coins, and which can count coins very reliably and promptly.

BRIEF DESCRIPTION OF THE DRAWINGS

Other objects and advantages of the present invention will become apparent from the following description made with reference to the accompanying drawings, in which.

DETAILED DESCRIPTION OF THE PREFERRED EMBODIMENTS OF THE INVENTION

Figure 1:
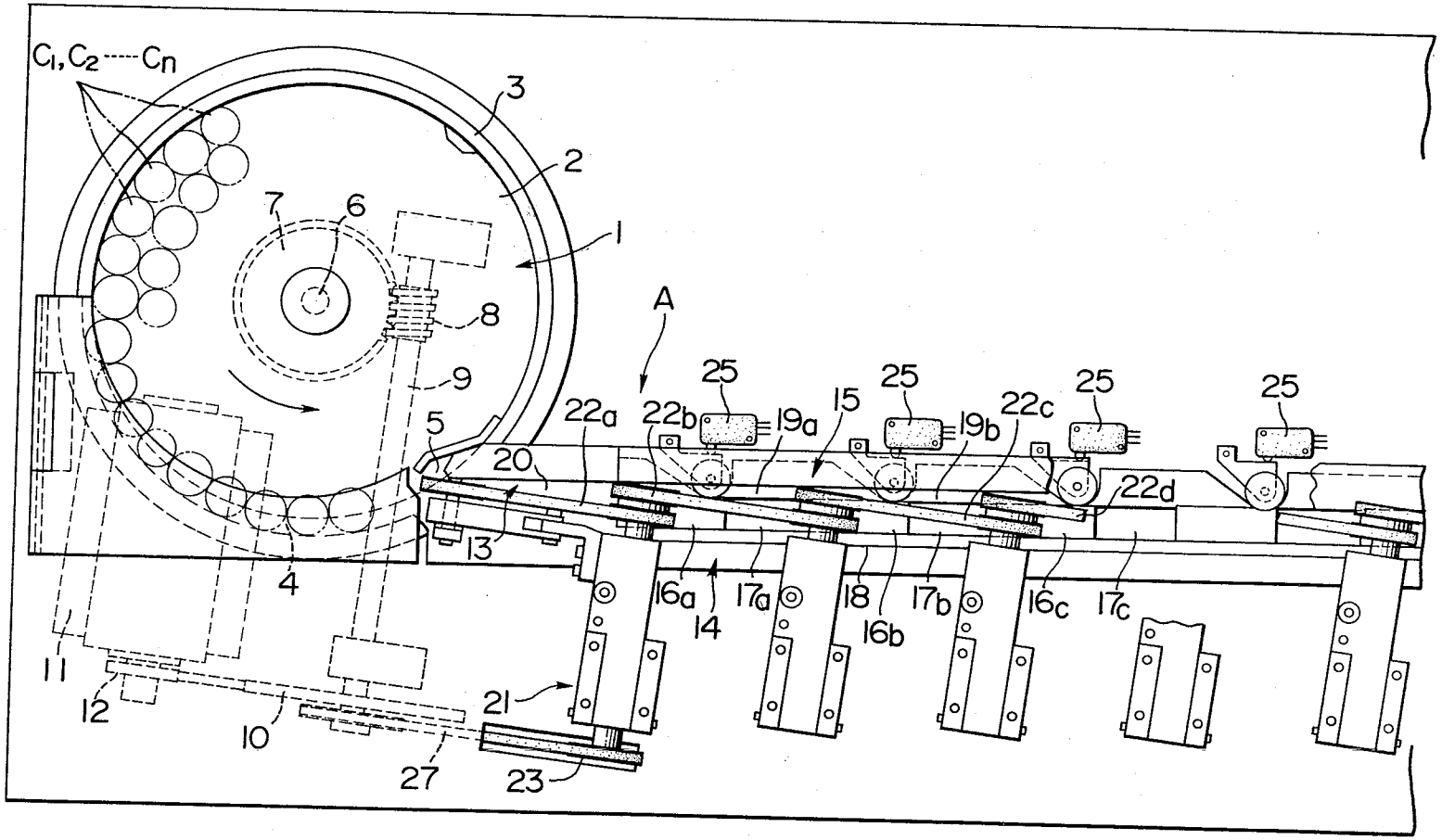
FIG. 1 is a top plan view showing an assorting and counting mechanism according to the present invention.
Figure 2:
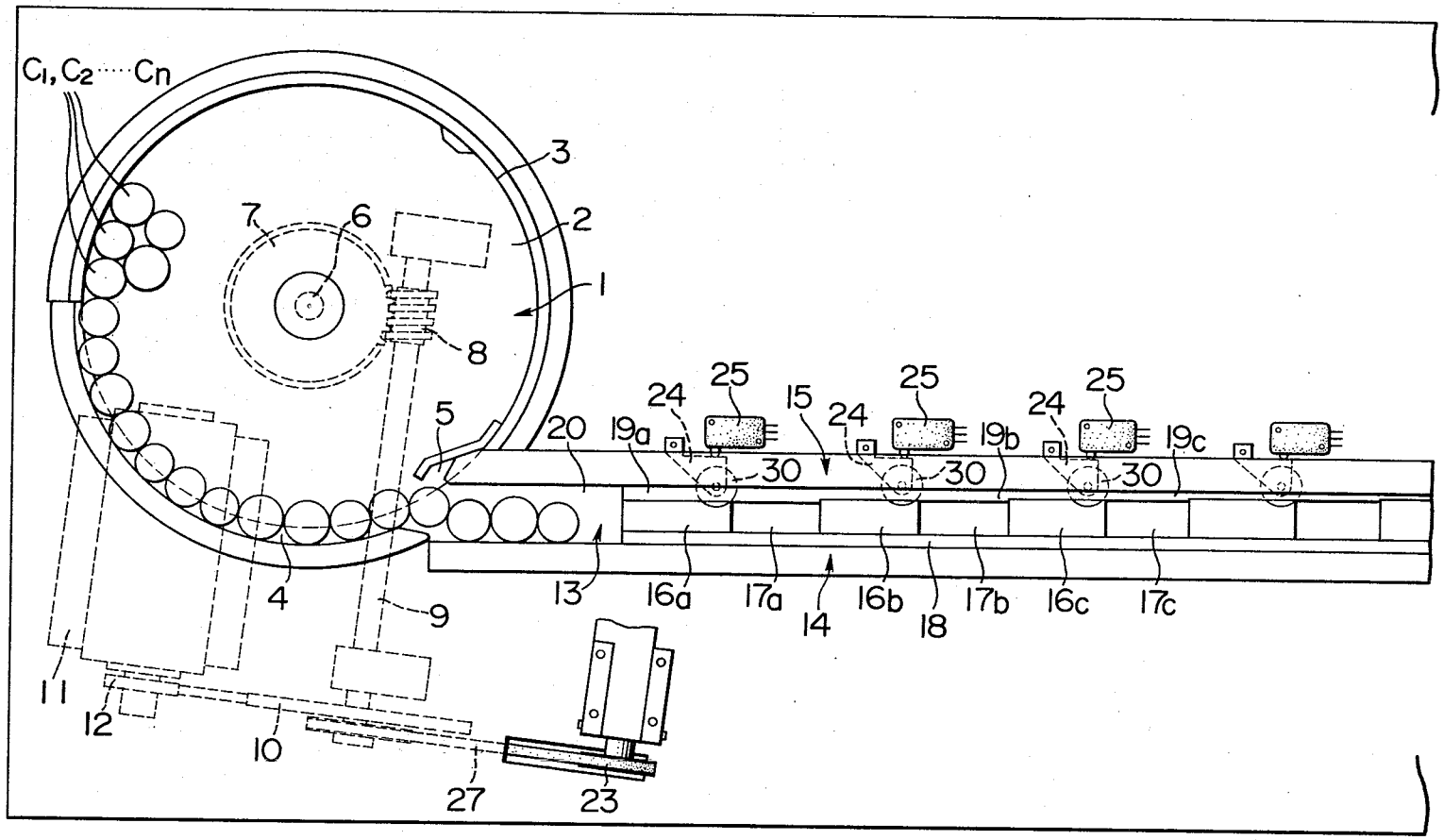
FIG. 2 is a top plan view showing the assorting and counting mechanism with the assorting belt mechanism being abbreviated for clarity of illustration.
Figure 3:
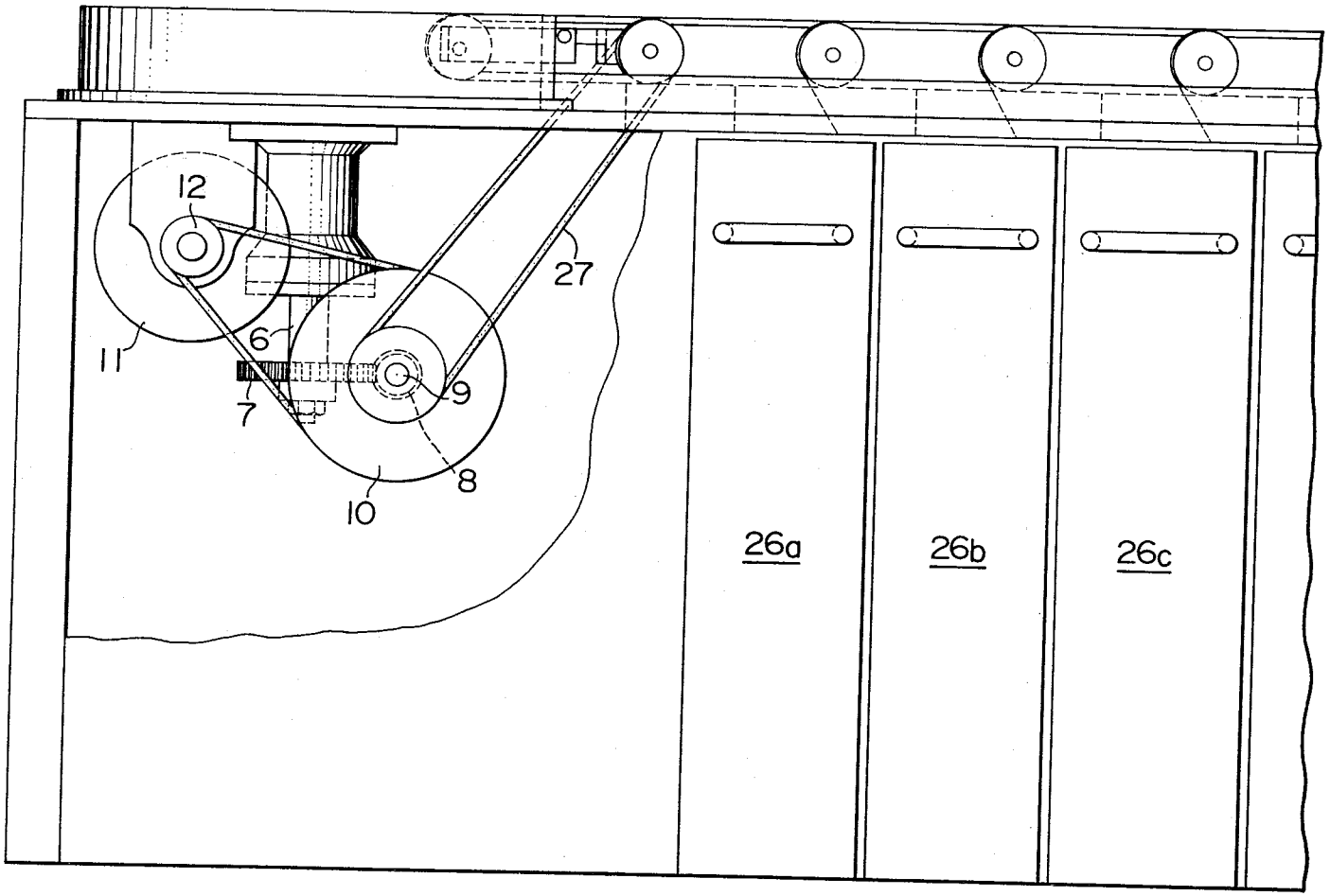
FIG. 3 is a side view.

One embodiment of the present invention will now be described in detail with the reference to the accompanying drawings.

Various kinds of mixed coins $C_1, C_2, \ldots C_n$ on a disc 2 of a rotary disc zone 1 are transferred to a coin aligning course 4 along an assorting ring 3 by the centrifugal force of the disc 2, and in the coin aligning course 4, the mixed coins $C_1, C_2, \ldots C_n$ are aligned and are continuously fed to a discharge opening 5.

A small gear 8 is engaged with a large gear 7 fixed to a rotation shaft 6 of the disc 2, and a drive pulley 10 is fixed to one end of a shaft 9 of the small gear 8. This drive pulley 10 is connected to a motor 11 through a pulley 12 fixed to the motor 11 and a belt so that the drive pulley 10 is rotated by the motor 11 and the turning effort of the motor 10 is transmitted to the disc 2 through the drive pulley 10. A coin introducing opening of an assorting and counting track 13 is connected to the discharge opening 5 of the rotary disc zone 1.

The assorting and counting track 13 comprises a linear standardizing rail 14 for delivering coins in a line, an assorting rail 15 and inclined counting stands 16*a*, 16*b*, 16*c*, . . . , and located just after the inclined counting stands 16*a*, 16*b*, 16*c*, . . . , are various coin dropping holes 17*a*, 17*b*, 17*c*, . . . (the width of which increases in the mentioned order) differing in width and defined by the standardizing rail 14 and assorting rail 15. A guiding edge 18 having a certain width is formed on the standard rail 14, and assorting edges 19*a*, 19*b*, 19*c*, . . . differing in projection length are formed on the assorting rail 15. The inclined stands 16*a*, 16*b*, 16*c*, . . . are formed to have widths corresponding to the projection lengths of the corresponding assorting edges 19*a*, 19*b*, 19*c*, . . . so that the coins $C_1, C_2, \ldots C_n$ are delivered placed on the guiding edge 18 and the assorting edges 19*a*, 19*b*, 19*c*, . . . .

The above-mentioned inclined counting stands 16*a*, 16*b*, 16*c*, . . . and coin dropping holes 17*a*, 17*b*, 17*c*, . . . are arranged so that stands having a smaller width and holes having a small width are located nearer to the rotary disc zone 1 and coins are successively assorted beginning with those of a smaller diameter. A delivery bottom plate 20 is formed on the bottom face of the assorting track 13 in the region between the discharge opening 5 and the first inclined counting stand 16a. Each of the inclined counting stands 16*a*, 16*b*, 16*c*, . . . and coin dropping holes 17*a*, 17*b*, 17*c*, . . . has a width slightly larger than the diameter of the corresponding coins $C_1, C_2, C_3, \ldots$. While the mixed coins $C_1, C_2, \ldots C_n$ are being transferred in one direction on the assorting and counting track 13, the falling coins $C_1, C_2, C_3, \ldots$ are introduced to the inclined counting stands 16*a*, 16*b*, 16*c*, . . . and are allowed to fall through the falling holes 17*a*, 17*b*, 17*c*, . . . . For this operation, an assorting belt mechanism 21 is disposed above the assorting and counting track 13. This belt mechanism 21 comprises a plurality of coin delivery belts 22*a*, 22*b*, 22*c*, . . . . These coin delivery belts run above the delivery bottom plate 20, the inclined counting stands 16*a*, 16*b*, 16*c*, . . . and the coin dropping holes 17*a*, 17*b*, 17*c*, . . . , and extend from the side of the assorting rail 15 toward the standardizing rail 14 so as to gradually approach the standardizing rail 14 while they are running.

A pulley 23 is driven by the motor 11 through a belt 17 to turn the coin delivery belt 22a of the assorting belt mechanism 21, the subsequent coin delivery belt 22b is turned by the coin delivery belt 22a and the remaining coin delivery belts are similarly turned by the preceding coin delivery belts, respectively.

Figure 4:
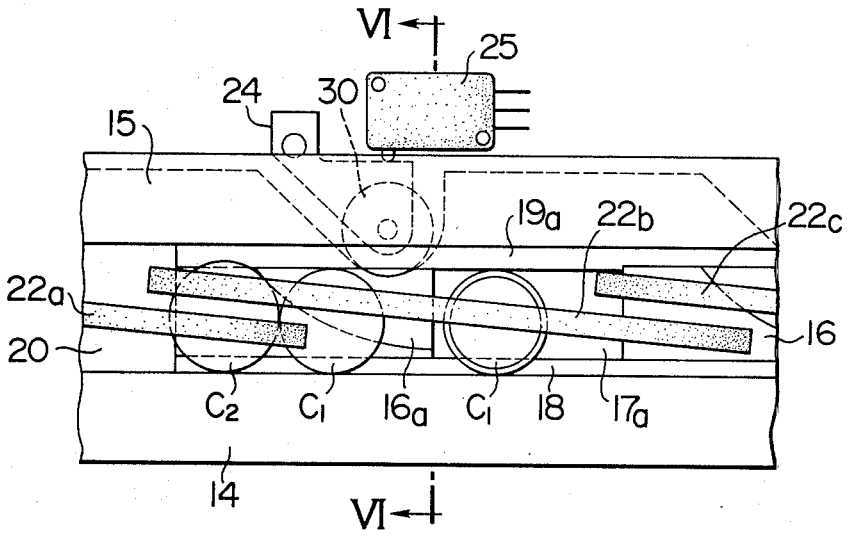
FIG. 4 is a partially enlarged top plan view showing the zone A of FIG. 1.
Figure 5:
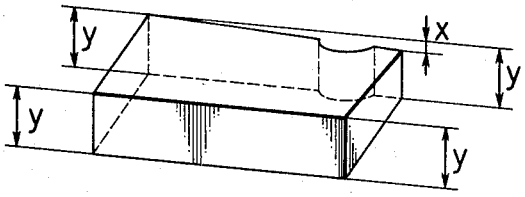
FIG. 5 is a perspective view showing an inclined counting stand for use in the assorting and counting mechanism.
Figure 6:
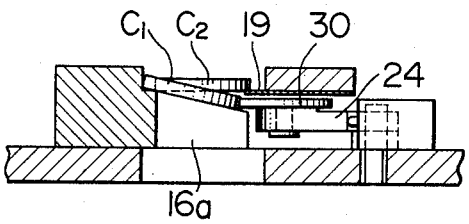
FIG. 6 is a cross-sectional view taken along lines VI—VI of FIG. 4.

As shown in FIGS. 4 and 5, the inclined counting stands 16a, 16b, 16c, . . . have an inclined face having a lowermost point at the terminal end of the assorting edges 19a, 19b, 19c, . . . and an uppermost point on the guide edge 18 and the disc 2 (see the relation between the distances x and y in FIG. 5). A counting roller 30 is disposed at the midway point of the assorting rail 15 at a point lower by one stage than the position of the assorting edges 19a, 19b, 19c, . . . so that a switch 25 (such as a micro-switch, a proximity switch, a photoelectric switch or the like) is actuated by a counting arm 24 attached to the counting roller 30.

After counting, the coins $C_1$, $C_2$, . . . $C_n$ are introduced into receipt boxes 26a, 26b, . . . 26n from the coin dropping holes 17a, 17b, . . . 17n.

The operation of an embodiment of the present invention having the above-mentioned structure will now be described.

When the mixed coins $C_1$, $C_2$, . . . $C_n$ are allowed to fall on the disc 2 from a hopper (not shown), the mixed coins $C_1$, $C_2$, . . . $C_n$ are fed along the assorting ring 3 to the coin aligning course 4 by the centrifugal force of the disc 2 and they are arranged in a line and fed to the discharge opening 5. The mixed coins $C_1$, $C_2$, . . . $C_n$ fed to the discharge opening 5 are transferred on the delivery bottom plate 20 of the assorting and counting track 13 in one direction by the coin delivery belt 22a of the assorting belt mechanism 21. The mixed coins $C_1$, $C_2$, . . . $C_n$ delivered by the coin delivery belt 22a are transferred to the subsequent coin delivery belts 22b, 22c, . . . . Since these coin delivery belts 22a, 22b, 22c, . . . are directed toward the side of the standardizing rail 14, the coins $C_1$, $C_2$, . . . $C_n$ are transferred in the state where one end of each coins is moved along the standardizing rail 14. Accordingly, the minimum diameter coin $C_1$ is transferred to the inclined counting stand 16a closest to the rotary disc zone 1 and the portion of the coin $C_1$ on the side of the assorting rail 15 is brought down along the inclined face of the counting stand 16a inclined toward the assorting rail 15. As a result, the counting roller 30 disposed at the midway point of the inclined counting stand 16a at a position lower by one stage than the position of the assorting edge 19a is operated by the so delivered coin $C_1$. At the same time, the counting arm 24 swinging together with the counting roller 23 actuates the switch 25 to effect counting and display by a counting device (not shown). The counted coin $C_1$ is allowed to fall from the coin dropping hole 17a disposed just after the inclined counting stand 16a, and introduced into the receipt box 26a. The coins $C_2$, $C_3$, . . . $C_n$ other than the minimum diameter coin $C_1$ are transferred by the coin delivery belt 22b while being carried on the guide edge 18 and assorting edge 19a, and in this state, they pass through the inclined counting stand 16a for the minimum diameter coins. These coins $C_2$, . . . $C_n$ are counted, assorted and allowed to fall at positions corresponding to their diameters in the same manner as described above.

As will be apparent from the foregoing detailed description, according to the present invention, coins to be assorted, allowed to fall and which are then stored can be directly counted on the horizontal track, therefore allowing the counting operation to be performed assuredly at a high speed. Moreover, the structures of the assorting and counting mechanisms can be remarkably simplified so that the coin assorting and counting apparatus can be provided at a low cost.

What is claimed is:

1. An apparatus for assorting and counting coins of different kinds by transferring mixed coins having different diameters in one direction on an assorting and counting track having a bottom face and a standardizing rail by an assorting belt mechanism and allowing the coins being transferred to fall through various assorting holes differing in width by utilizing said different diameters among the mixed coins, so as to count the number of respective kinds of coins, said assorting holes being formed on the bottom face of said assorting and counting track, wherein each assorting hole has a width slightly larger than the diameter of corresponding coins to be introduced into said each assorting hole, said apparatus comprising a plurality of inclined counting stands, each having a width substantially equal to the width of said each assorting hole and each having one side thereof inclined, each said inclined counting stand being disposed within a respective one of said assorting holes, and a plurality of counting devices, one for each said inclined counting stand and disposed adjacent to said inclined side of said each counting stand so as to be engageable with each corresponding coin for counting the number of coins introduced into said each inclined counting stand, said assorting belt mechanism including a plurality of belts disposed so as to be parallel to each other and disposed at an angle relative to the counting track so as to drive coins along the standardizing rail of the assorting and counting track, said belts imparting to said coins falling in the assorting holes sufficient movement force to cause said coins to pass by respective said counting device, said standardizing rail including a guiding edge, said coins remaining in contact with said guiding edge of said standardizing rail while said coins are being counted.

2. An apparatus as set forth in claim 1 wherein said counting device comprises a counting roller engageable with each coin which is assorted by one of said assorting holes, a counting arm pivotably mounted and provided with said counting roller and a switch actuated by the counting arm to give a count.

* * * * *